US012729678B2

(12) United States Patent
Stuart et al.

(10) Patent No.: US 12,729,678 B2
(45) Date of Patent: Sep. 8, 2026

(54) APPARATUS AND METHOD OF PRE-PREPARING A LIQUID DELIVERY DEVICE VALVE FOR USE

(71) Applicant: Merxin Ltd, King's Lynn (GB)

(72) Inventors: Adam Stuart, Pott Row (GB); Dylan Antoniak, King's Lynn (GB)

(73) Assignee: Merxin Ltd, King's Lynn (GB)

( * ) Notice: Subject to any disclaimer, the term of this patent is extended or adjusted under 35 U.S.C. 154(b) by 0 days.

(21) Appl. No.: 19/237,727

(22) Filed: Jun. 13, 2025

(65) Prior Publication Data

US 2025/0382958 A1 Dec. 18, 2025

(30) Foreign Application Priority Data

Jun. 14, 2024 (GB) ..... 2408573

(51) Int. Cl.
*F04B 51/00* (2006.01)
*F04B 37/12* (2006.01)
*F04B 53/12* (2006.01)

(52) U.S. Cl.
CPC ..... *F04B 51/00* (2013.01); *F04B 37/12* (2013.01); *F04B 53/12* (2013.01)

(58) Field of Classification Search
CPC ..... F04B 51/00; G01F 15/005
USPC ..... 29/890.12; 137/15.01; 73/1.17, 168
See application file for complete search history.

(56) References Cited

U.S. PATENT DOCUMENTS

2002/0130195 A1 9/2002 Jaeger et al.
2007/0012798 A1* 1/2007 Cooke ..... F02M 61/188 239/102.2

FOREIGN PATENT DOCUMENTS

EP 1589336 A1 * 10/2005 ..... G01N 30/32

OTHER PUBLICATIONS

United Kingdom Intellectual Property Office, Combined Search and Examination Report under Section 17 and 18(3), Application No. 2408573.0 Mailed Oct. 16, 2024, 5 pages.

* cited by examiner

*Primary Examiner* — Kenneth J Hansen
(74) *Attorney, Agent, or Firm* — Ziegler IP Law Group, LLC.

(57) ABSTRACT

A method of pre-preparing a liquid delivery device valve includes (i) fluidically connecting at least that part of the liquid delivery device that contains the valve to a pumping system; (ii) connecting the pumping system to a fluid reservoir; (iii) running the pumping system so that fluid from the reservoir is forced through the valve under pressure, at a rate of flow that will cause necessary deformation and bedding-in of the valve.

9 Claims, 8 Drawing Sheets

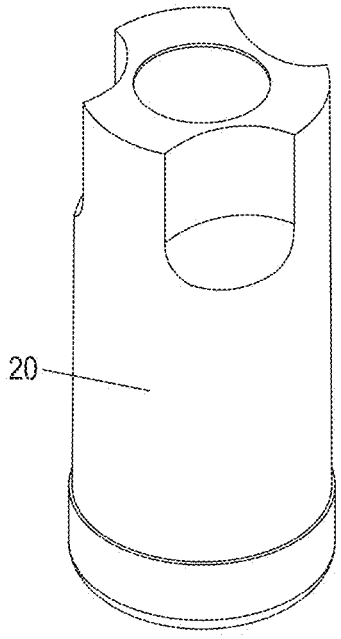
Figure 8 (Prior Art)
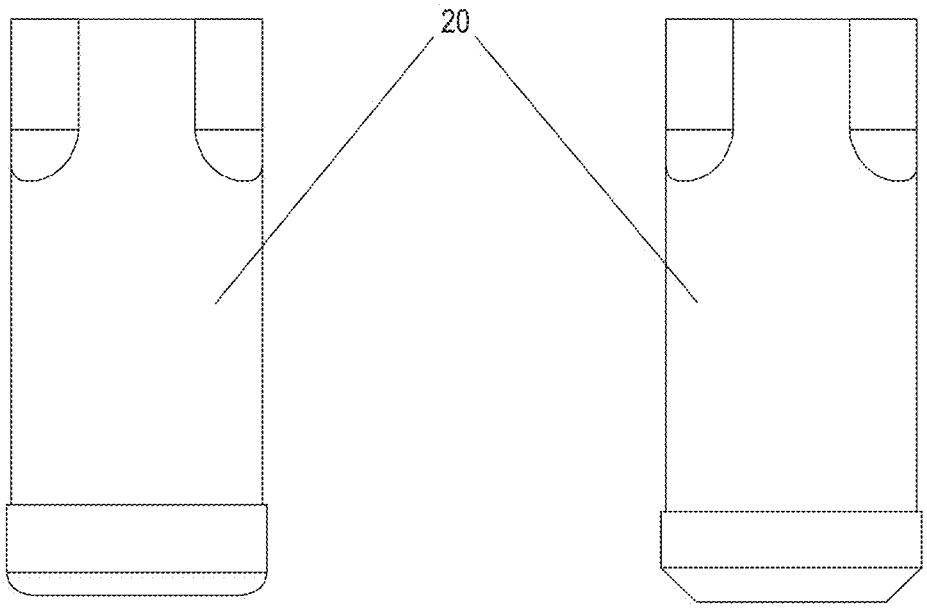
Figure 9a (Prior Art)
Figure 9b (Prior Art)

APPARATUS AND METHOD OF PRE-PREPARING A LIQUID DELIVERY DEVICE VALVE FOR USE

TECHNICAL FIELD

The aspects of the disclosed embodiments relate to an apparatus for pre-preparing a liquid delivery device valve for use. The aspects of the disclosed embodiments also relate to a method of pre-preparing a liquid delivery device valve for use.

BACKGROUND

Drug delivery devices such as nebulisers are used to produce an aerosol of droplets for inhalation into the lungs of a patient through the mouth and pharyngeal cavity, for nasal administration, or for spraying the surface of the eye. A drug delivery device of this type is a particular form of liquid delivery device.

In a nebulising drug delivery device such as a soft mist inhaler (SMI), liquid pharmaceutical formulations are typically stored within the drug delivery device in a reservoir located in the lower part of the casing of the SMI. In a typical known type of SMI, the liquid pharmaceutical formulations are conveyed from the reservoir, through a riser tube running within the SMI from the lower part to the upper part, and into a pressure chamber located in the upper part. The liquid formulation is then forced through a nozzle under pressure and atomised. In this way, drug delivery devices such as SMIs are able to nebulise a small amount of a liquid formulation within a few seconds, in order to produce a required dosage in aerosol form suitable for therapeutic inhalation. Moreover, this can be achieved without requiring the use of a separate propellant.

A typical known type of SMI or nebuliser device is shown in FIGS. 1 to 3. The device has an upper half that contains a pump core that comprises a nozzle, and a mouthpiece. The lower half in use contains a reservoir of liquid. A riser tube extends axially along the device from the reservoir to the nozzle. In use, the upper and lower halves are rotated relative to one another to pump or prime the device. When the device is subsequently triggered by a user, liquid is forced through the nozzle under pressure so that it becomes a nebulised mist that is delivered to a user.

A piston is contained within the Soft Mist Inhaler, to enable this delivery process. The valve inside pistons of the type used in SMIs is very small and contains an ~1 mm one-way valve made from Polypropylene or similar. In use, the valve must shuttle or cycle easily in order to allow liquid to fill the pump core under low pressure but then robustly seal off against the tube during actuation, without the material of the body of the valve extruding under the high actuation pressures. This helps to ensure that the inhaler is delivering a nebulised mist as intended. It can be seen that due to the dimensions and materials used, the valve is a very sensitive part of the soft mist inhaler. Due to the manufacturing and tolerancing difficulties related to manufacturing such a small component, these valves often need to be bedded in under pressure to ensure that the form on the end of the valve is correctly sealing against/with the piston tube which connects to the liquid reservoir. Typically, such devices are currently tested by firing the device multiple times using a liquid such as ethanol, until the device has been suitably prepared or conditioned for use, with the valve functioning correctly. This testing can take up to ten actuations, and its efficacy relies on the impact pressure from the pump core. A high pressure is experienced during priming actuations due to the compressibility of air vs the fluid and the "hammer effect" of this cycling, which causes a sudden rise in pressure in the pump core and the piston. Testing of this type slows down assembly production due to the time taken to carry out the actuations, and it also requires costly assembly equipment. Another disadvantage of this approach is that any dose counters built into the SMIs need to be designed in such a way that they take into account the additional testing actuations that are conducted before any actual use has taken place. This adds to the design and manufacturing complexity.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

SUMMARY

The aspects of the disclosed embodiments are directed to providing an apparatus for pre-preparing a liquid delivery device valve for use which goes some way to overcoming the abovementioned disadvantages or which at least provides the public or industry with a useful choice.

The aspects of the disclosed embodiments are also directed to providing a method of pre-preparing a liquid delivery device valve for use which goes some way to overcoming the abovementioned disadvantages or which at least provides the public or industry with a useful choice.

Accordingly, in a first aspect the disclosed embodiments may broadly be said to be directed to a method of pre-preparing a liquid delivery device valve, comprising the steps of:

(i) fluidically connecting at least that part of the liquid delivery device that contains the valve to a pumping system;

(ii) connecting the pumping system to a fluid reservoir;

(iii) running the pumping system so that fluid from the reservoir flows under pressure through that part of the liquid delivery device that contains the valve so as to force the valve to close, the fluid flowing at a rate of flow that will cause necessary deformation and bedding-in of the valve.

In an embodiment, in step (iii) the fluid is set to flow at a rate of flow higher than the flow rate used for normal operation In an embodiment, in step (iii) the fluid flow rate is set so that there is an initial 'spike'—that is, the flow rate rapidly increases from zero or a low flow rate, to a high flow rate In an embodiment, in the step of connecting the pump to a fluid reservoir, the pump is connected to a reservoir containing ethanol.

In an embodiment, in the step of running the pump, the pump is run so as to deliver fluid through the liquid delivery device up to a maximum pressure of substantially 500 Bar.

In an embodiment, in the step of running the pumping system, a plurality of full pump sequences are run.

In an embodiment, the valve comprises a one-way valve, the method comprising the further step of:

(iv) reversing the direction of flow so that flow is in the normal use direction, to check that the valve is not stuck and still shuttles correctly.

In an embodiment, the method of pre-preparing a liquid delivery device valve comprises the further step of:

(v) again changing the direction of flow, to check that robust sealing has been achieved.

In an embodiment, in any one or more of steps (i) to (vi), the pressure is measured within that part of the liquid delivery device that contains the valve.

The aspects of the disclosed embodiments may also be said broadly to comprise in the parts, elements and features referred to or indicated in the specification of the application, individually or collectively, and any or all combinations of any two or more said parts, elements or features, and where specific integers are mentioned herein which have known equivalents in the art to which this present disclosure relates, such known equivalents are deemed to be incorporated herein as if individually set forth.

Therefore, the foregoing is considered as illustrative only of the principles of the disclosed embodiments. Further, since numerous modifications and changes will readily occur to those skilled in the art, it is not desired to limit the disclosed embodiments to the exact construction and operation shown and described, and accordingly, all suitable modifications and equivalents may be resorted to, falling within the scope of the present disclosure.

BRIEF DESCRIPTION OF THE DRAWINGS

One or more embodiments of the present disclosure will now be described, by way of example only, with reference to the accompanying drawings, in which:

FIG. 8 shows a perspective view from one side and above of the valve of FIG. 7.

FIGS. 9*a* and 9*b* show the known type of valve of FIG. 6 when it is new and unused, and when it has been bedded-in, respectively.

DETAILED DESCRIPTION

Detailed embodiments of the present disclosure will now be described with reference to the figures.

General

Figure 1:
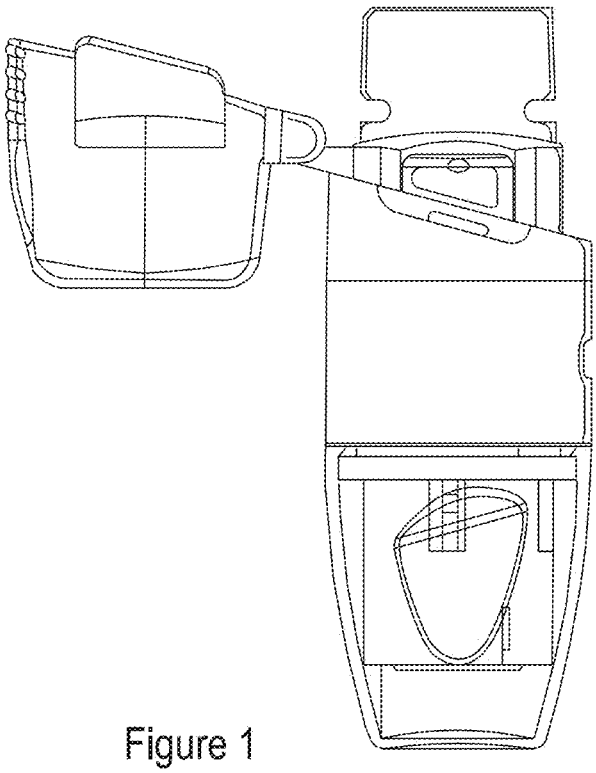
Figure 1 (prior art)
FIG. 1 shows a side view of a known, prior art type of manually-operated nebuliser that has an upper half and a lower half, the two halves rotated relative to one another in use to pump or prime the device for use.
Figure 2:
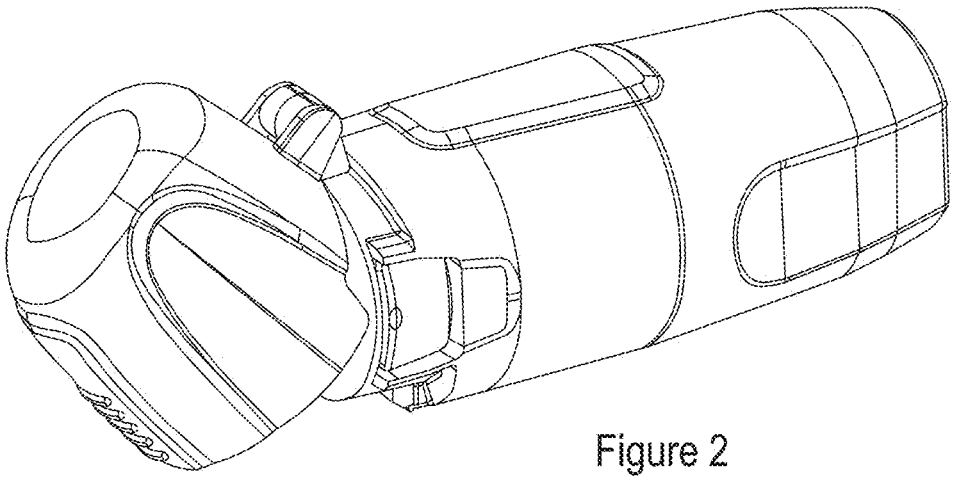
Figure 2 (prior art)
FIG. 2 shows a perspective view from one side and slightly above of a known, prior art nebuliser similar to that of FIG. 1, the nebuliser having a lid that is shown slightly open.
Figure 3:
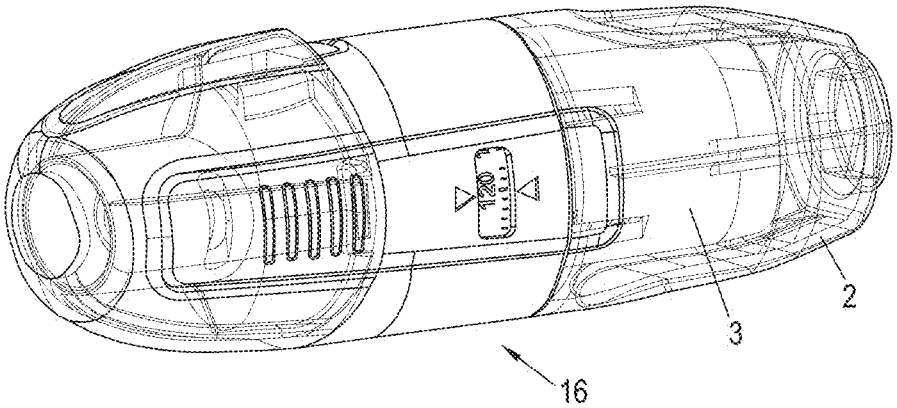
Figure 3 (prior art)
FIG. 3 shows a perspective view of a known, prior art nebuliser from generally the same angle as that of FIG. 2 but with the lid closed, the outer casing elements of the lower half of the nebuliser shown semi-transparent so as to show internal detail of the reservoir.
Figure 4:
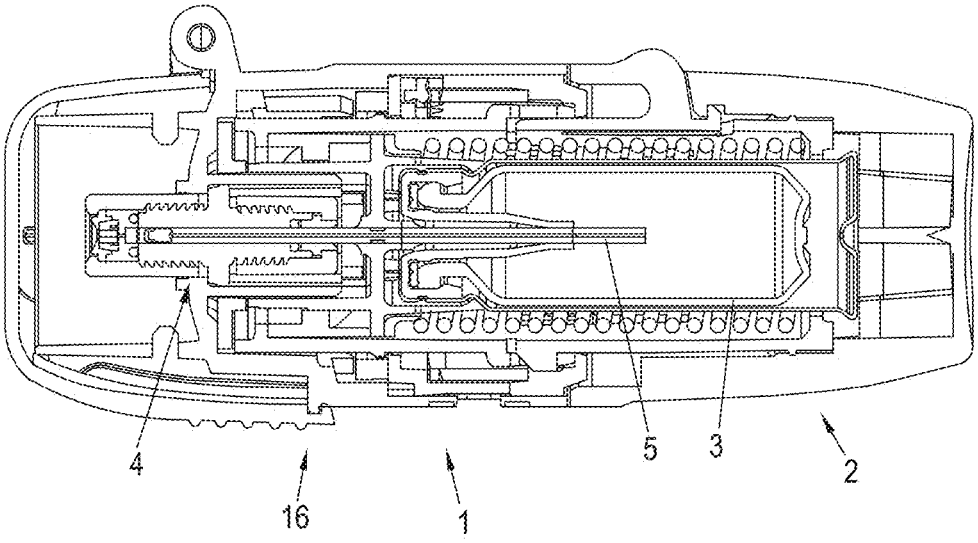
Figure 4 (prior art)
FIG. 4 shows a cutaway side view of the known, prior art nebuliser of FIGS. 1 to 3, showing detail of the internal mechanism, the mechanism including a reservoir enclosed within a lower housing, a pump core enclosed within an upper housing, and a tube connecting between the two, the tube configured to deliver fluid from the reservoir to the pump core, the pump core comprising a piston head comprising a valve at the outlet end.

As shown in FIG. 4, a typical known type of SMI 1 comprises a lower housing part 2 that contains a cartridge 3 that forms a liquid reservoir for the device, and an upper housing part 16 that contains a core 4. The core 4 typically comprises a nozzle assembly and a mouthpiece, with a riser tube or capillary tube 5 extending between the nozzle assembly and the cartridge. In use, liquid from the cartridge 3 is sucked up the tube 5 towards the nozzle assembly and delivered through the mouthpiece via the nozzle assembly.

Figure 5:
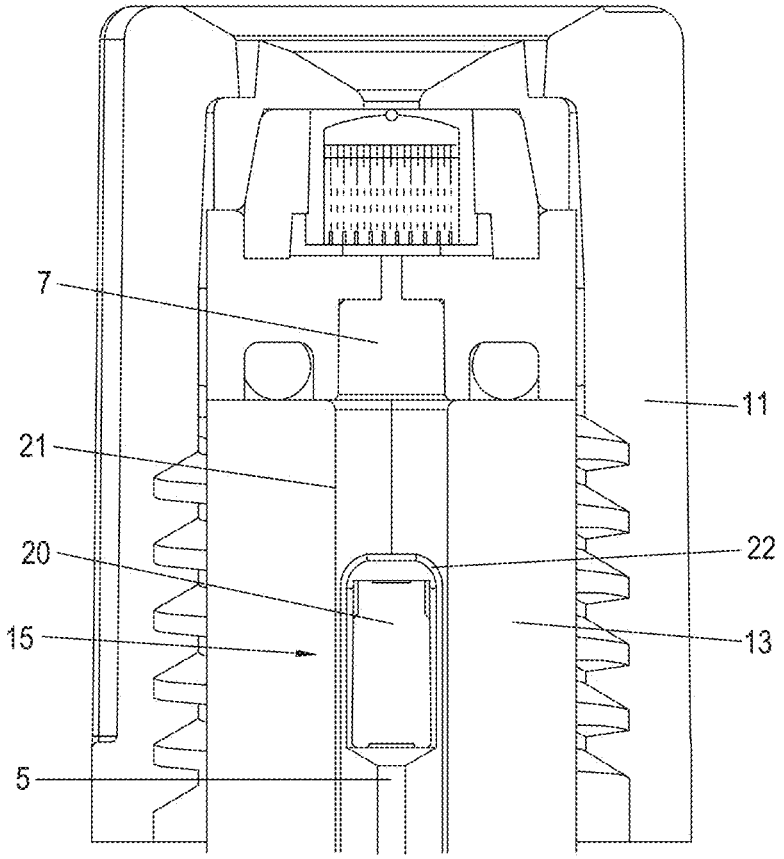
FIG. 5 shows a schematic cutaway side view of a nozzle assembly which is located at the upper end of the nebuliser of FIG. 4, the nozzle assembly comprising an upper tube housing, a top nut that screws onto the upper tube housing, with the upper tube housing having a central axial passage running therethrough, the passage containing a tube that moves axially/vertically within the tube housing.

A cross-section of a typical known type of nozzle assembly is shown in FIG. 5. The nozzle assembly comprises a number of elements, that are contained within a top nut 11, the top nut 11 screwing onto an upper tube housing 13 to retain these elements in place. The upper tube housing 13 has a central axial passage 21 running therethrough. In use, the passage 21 contains a tube 5, with tube 5 moving axially/vertically within the tube housing 13).

As outlined above, the tube 5 moves along the passage 21 within the upper tube housing 13. The head of the tube 5 comprises a piston head 15 that fits snugly within the passage, with the passage 21 forming a cylinder bore for the piston 15. In use, fluid from the reservoir (cartridge 3) travels through the hollow centre of the tube 5 (which forms a capillary passage), and during use is forced under pressure through the pre-filter 7, which is located directly above the top end of the passage.

Figure 6:
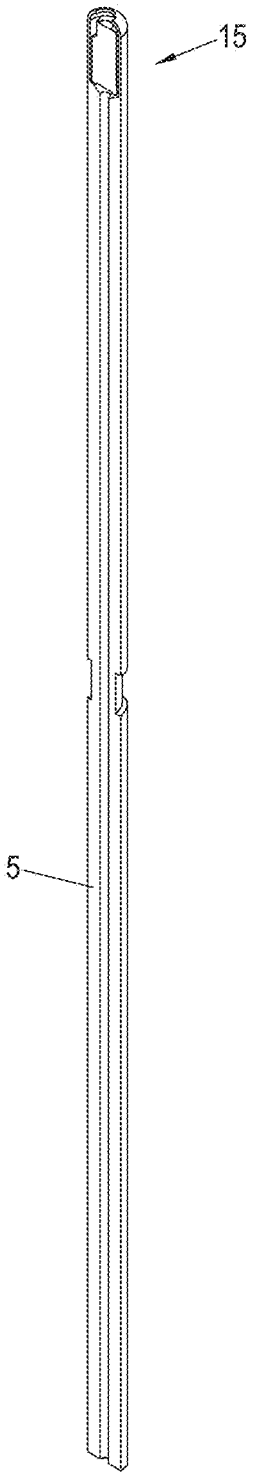
FIG. 6 shows a perspective cutaway view of a tube suitable for use within the passage of the upper tube housing.
Figure 7:
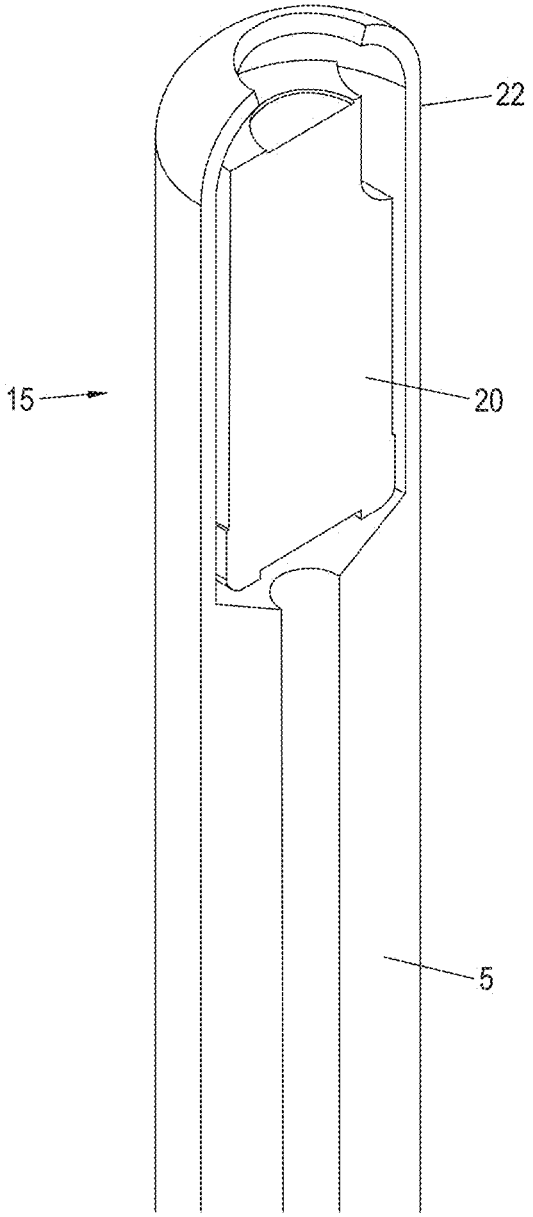
FIG. 7 shows a cutaway perspective view of the top end of the tube of FIG. 6, the head of the tube comprising a piston head or piston crown that fits snugly within the passage, the tube and piston head locating into the passage so as to form a piston, with the tube housing forming a cylinder bore for the piston the head comprising an internal one-way piston valve, contained within a cone.
Figure 10:
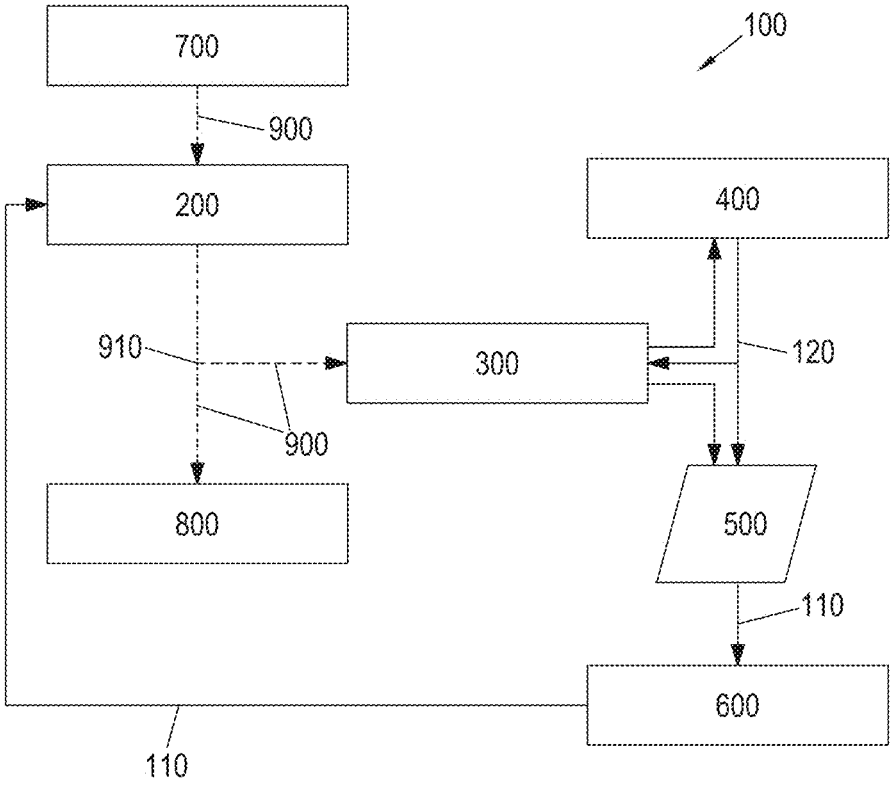
FIG. 10 shows a simplified schematic overview of an embodiment of the preparation system of the present disclosure, the system comprising a high pressure pumping system, a pressure sensor or sensors connected to the pumping system to measure the pressure or resistance of the liquid delivery device, a power supply to power the pressure sensor(s), a computer adapted to connect to and control the pump and to receive data from the pressure sensor(s) via a data capture device, with the pump receiving fluid from a reservoir, and the delivery device to be tested connected to a fixture.
Figure 11:
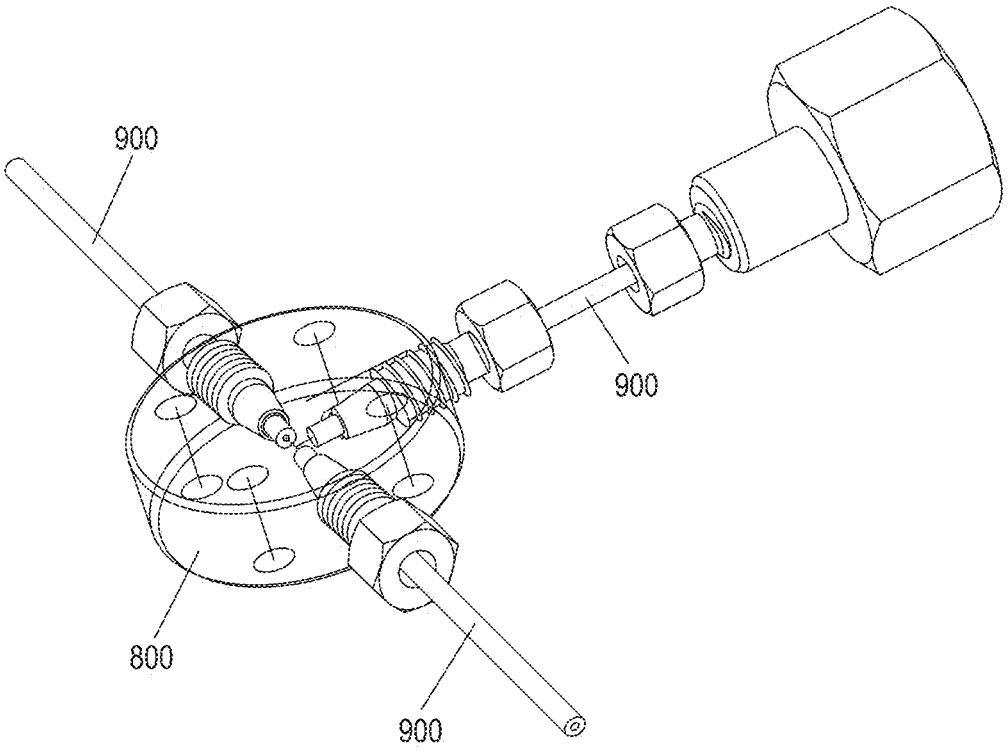
FIG. 11 shows an embodiment of a fixture suitable for testing pump cores, with the pump core to be tested connected to the fixture and the fixture fluidically connected to a pump via hydraulic tubing/connectors, the figure showing a three-way union to allow a pressure sensor to be connected in-line.

As shown in FIGS. 6 and 7, the head of the tube 5 comprises a piston crown or piston head 15 (tube 5 and piston head 15 locating into the housing 13 so as to form a piston, with the tube housing 13 forming a cylinder bore for the piston. It should be noted that 'cylinder bore' is the technical name for the passage within which a piston locates, and should not be taken as indicative of the passage within the upper tube housing 13 having to have a circular cross section. In this embodiment, the passage has a circular cross-section, but other cross-sectional shapes can also be used). As noted above, in use liquid from the cartridge 3 is sucked up the tube 5 towards the nozzle assembly and delivered to a user through the mouthpiece via the nozzle assembly.

In order for the liquid to be delivered to a user, it is first delivered into the space between the outer end of the piston head 15, and the inner end of the pre-filter 7. In use, the piston head 15 is driven towards the pre-filter, so that the increase in pressure within the space/decrease in volume of the space, drives the liquid in the space through the pre-filter 7, the chip/filter 10, and out of the mouthpiece.

As shown in FIG. 7, the piston head 15 comprises a cone 22 that forms a hollow internal space, with an open top end and a lower end that tapers conically to fluidically connect with the capillary passage. A one-way piston valve 20 is located in the hollow internal space. The valve has fluted sections at the upper end. In use, the valve 20 can move within the hollow internal space, so as to close the capillary passage through the hollow centre of the tube 5 when in a lower position. In an open position, away from the lower end, fluid can flow around the piston valve 20, around the fluted sections formed in the upper end. An example of a known type of valve is shown in FIG. 8. Valves of this type (the type used in SMIs) are very small-approximately 1 mm wide, and are made from Polypropylene or similar. The valves are required to be small in order to fit within the piston, and the piston itself is required to have a small diameter, in order to ensure that the operating pressure is high enough to deliver fluid/gas through the nozzle. If a larger diameter piston were used, the pressure could potentially cause breakage of components within the pump core. The material used for the valve is required to be slightly compliant in order to form a seal, but also stiff enough not to extrude down the tube under the high actuation pressures. Polypropylene is used for preference, but any material that exhibits a suitable balance in material properties between compliance and stiffness can potentially be used.

The long aspect ratio cylindrical body of this type of valve helps to ensure that the valve stays in the correct orientation between doses, and helps to prevent the valve from skewing during operation. As noted above, the valve has fluted sections at the upper end (towards the top of the page as best shown in FIG. 8) to allow flow past the swaged upper end of the tube when the valve is in the open position.

The inlet edge of the valve (towards the bottom of the page for the valve shown in FIGS. 8 and 9) is intended to form a seal against the tapering conical lower end of the hollow internal space of the piston head 15. Valves of this type are moulded, and when the valve is new and not yet used, the inlet edge can have small defects which can prevent a complete seal being formed.

As noted above and in the prior art section, due to the manufacturing and tolerancing difficulties related to manufacturing such a small component, these valves often need to be bedded-in under pressure to ensure that they seal correctly. The difference in profile between a new valve and a valve that has been bedded-in is shown in FIGS. 9*a* and 9*b*. As shown in FIG. 9*a*, the edge of the inlet end (towards the bottom of the page in FIG. 9) can be rounded or square when the valve is brand-new. Small defects on this edge can mean that when the valve is first used, a complete seal is not formed.

As shown in FIG. 9*b*, after the valve has been bedded-in, the lower or inlet end of the valve deforms to become tapered or conical after a number of initial uses, with the material of the lower end also deforming outwards slightly. This helps to ensure that a complete seal is formed in use.

A typical way in which this bedding-in and testing process can be carried out is by connecting it to a reservoir of a test liquid such as ethanol, and then firing the device multiple times until the device is "primed" and the valve is functioning correctly. This testing process can be up to ten actuations (firings), and its efficacy relies on the impact pressure from the pump core. A high pressure is experienced during priming actuations due to the difference between the compressibility of air and the compressibility of the test fluid, and the "hammer effect" of this cycling. This causes a sudden rise in pressure in the pump core and the piston. Testing of this type slows down assembly production due to the time taken to carry out the actuations, and it also requires costly assembly equipment.

An alternative apparatus and method of pre-preparing a liquid delivery device valve is outlined below.

Apparatus for Pre-Preparing a Liquid Delivery Device Valve

A simplified overview schematic of an embodiment of the apparatus 100 used for this type of test is shown in FIG. 6.

The apparatus 100 comprises a high pressure pumping system 200, and a pressure sensor or sensors 300 connected the pumping system 200 to measure the pressure or resistance of the tube 5 and valve 20. A power supply 400 is provided to power the pressure sensor(s) 300. A computer 600 is adapted to connect to and control the pump 200, and to receive data from the pressure sensor(s) 300 via a data capture device 500. The pump 200 receives fluid from a reservoir 700.

In use, a subassembly of the SMI 1 that includes the tube 5 and upper tube housing 13 is connected to a fixture 800, with the fixture 800 fluidically connected to the pump 200. In the preferred embodiment, the pump 200 pumps a liquid at high pressure through the tube 5 at a given flow rate, and the response from the pressure sensor(s) 300 is used to determine if the valve 20 of the piston is functioning correctly. However, it should be noted that other fixed parameters could also be used in place of flow rate, such as for example piston delivery or pressure delivery (that is, an input parameter comprising for example a piston of known size, travelling a known distance, with either a known force or time between points, could be used to provide the input flow or pressure).

Fluidic connections are made between the pump 200, the pressure sensor 300, the reservoir 700, and the fixture 800, via hydraulic tubing/connectors 900.

High Pressure Pumping System

In this embodiment, the pump 600 comprises a Knauer Azura 6.1 L isocratic pump, which can produce a flow of 0.001-10 mL/min, with a maximum pressure of 862 bar.

Power Supply

In this embodiment, the power supply 400 comprises a stable DC power supply. It is preferred that a stable DC power supply is used, in order to reduce the rippling effect observed when using AC/DC electrical supplies. This ripple effect can cause 'noise' in the readings which can unacceptably distort the results. The power supply 400 is connected to the pressure sensor 300 and the data capture device via power cables 120 so as to provide power in use.

Data Capture Device

A data capture device is required. In this embodiment, the data capture device 500 comprises a National Instruments card NI 9205. Suitable alternatives could be used.

Computer

Any suitable computing device capable of running software to control the pump and capable of receiving data from the data capture device can be used as the computer 600. In this embodiment, the computer used is chosen so as to be able to run NI DAQExpress software, so as to record data from the NI 9205 card. The computer is connected via cables 110 to the pump 2 and the data capture device 500, so as to receive and send signals to and from these devices as required.

Tubing/Connectors

In this embodiment, stainless steel capillary tubing and fittings are used as the hydraulic tubing 900, in order to provide robust seals which can take high pressures without leaking. PEEK connections are prone to leaking under the rapid increases of pressure and it is therefore preferred that 0.5 mm ID/1/16" OD Stainless Steel Capillary Tubing is used, along with Stainless Steel ferrules and nuts.

Although PEEK tubing can be used, this has a lower maximum pressure rating and so it is preferred that stainless steel tubing is used.

Two- and three-way unions are used to connect the hydraulic tubing 900 as required. A three-way union is used at the junction 910, as this allows the pressure sensor to be connected in-line.

Pressure Sensor

Any suitable pressure sensor 300 that enables high frequency sampling of pressure can be used. In this embodiment, a pressure sensor compatible with the chosen or preferred form of data capture device 500 is used. In the preferred embodiment, a Wika S-20 is used.

Fixture

An example of a fixture 800 suitable for testing piston tubes such as tube 5, and for bedding in valves such as valve 20, is shown in FIG. 7. In use, a subassembly that includes tube 5 is connected to the fixture 800, with the fixture 800 fluidically connected to the pump 200 via the hydraulic tubing/connectors 900. The pump 200 pumps a liquid at high pressure to the fixture 800, and then through the tube 5 at a given flow rate. The response from the pressure sensor(s) 300 is used to determine if the valve 20 is sealing correctly. FIG. 7 shows the preferred form of three-way connection.

As noted above, a three-way union is used at the junction 950, as this allows the pressure sensor to be connected in-line. FIG. 7 shows an example of this three-way connection.

Method of Pre-Preparing a Liquid Delivery Device Valve

In this embodiment of the method, a subassembly that includes the tube 5 of a soft mist inhaler is connected to the fixture 800.

The reservoir 700 is filled with HPLC grade ethanol, as this is the preferred form of fluid for testing. However, any other suitable fluid can be used instead.

The pump 200 is run so as to pump the ethanol through the tube 5 from the open upper end (that is, the reverse direction from normal use), so as to cause the valve 20 to move downwards, and to shut off by closing the top of the capillary passage. The pressure on the valve 20 from the upper end will cause any necessary deformation and bedding-in of the valve 20 at the lower end (e.g. deformation from the shape shown in FIGS. 8 and 9*a*, to that shown in FIG. 9*b*), without damaging the valve. As the aim is to make the valve shut off and cause an increase in pressure that will bed the valve in, the flow rate can be higher than that used for normal operation, and should preferably include an initial 'spike'—that is, rapidly increasing the flow rate from zero or a low flow rate, to a high flow rate (rather than a gradual build-up or gradual increase in flow from a low or zero flow rate).

As indicated above, the absolute flow rate and pressure level are dependent on the quality of the componentry on an individual basis, so the flow and pressure will vary for, and are unique to, each bedding-in operation. For example, if a valve undergoing the bedding-in operation has a crisp and clear sealing edge with no defects, then it will seal with almost zero flow and the pressure will ramp up quickly to a maximum (as the pump is pumping but there is nowhere for the flow to go). Alternatively, a valve with an uneven sealing edge or with a minor defect will not seal initially and therefore there will be flow through the valve until the pressure reaches a level that is high enough to start deforming the valve so as to create a seal to the tube cone. Once a seal begins to be formed, the flow will decrease and the pressure will increase, and the valve will further deform as it seals.

However, the rate of the flow decrease and pressure ramp up will vary on a valve-by-valve basis. Therefore, a maximum bedding-in pressure can be set if required, of substantially around 500 Bar, with the apparatus stopped or paused if the pressure exceeds this level.

The pressure sensor measures and reports a voltage to the computer 600 via the data capture device 500. The voltage measured corresponds to the pressure within the core 4. The voltage/pressure is measured over the full pump sequence-ramping up, steady state flow, and ramping down. If this exceeds 500 Bar, then the computer 600 will send signals to the pump 200 to either stop or to lower the pumping rate until the pressure as measured falls below 500 Bar.

The pressure/voltage is plotted against time.

The actions of the pump can firstly be used to bed in the valve 20 using a set flow rate or pressure in the reverse direction, as outlined above, and then the function of the valve 20 can be tested by again reversing the flow, back to the normal flow direction, to check that the valve is not stuck in the closed position and still shuttles correctly for use.

This test can also be used to filter out damaged valves, which previously had to be visually inspected prior to insertion. A further advantage is that damaged valves can become functional, due to the high levels of compression acting on the part during testing.

What is claimed is:

1. A method of pre-preparing a liquid delivery device valve, comprising the steps of:

(i) fluidically connecting at least that part of the liquid delivery device that contains the valve to a pumping system;

(ii) connecting the pumping system to a fluid reservoir;

(iii) running the pumping system so that fluid from the reservoir flows under pressure through that part of the liquid delivery device that contains the valve so as to force the valve to close, the fluid flowing at a rate of flow that will cause necessary deformation and bedding-in of the valve.

2. The method of pre-preparing a liquid delivery device valve as claimed in claim 1 wherein in step (iii) the fluid is set to flow at a rate of flow higher than the flow rate used for normal operation.

3. The method of pre-preparing a liquid delivery device valve as claimed in claim 1 wherein in step (iii) the fluid flow rate is set so that flow rate rapidly increases from zero or a low flow rate, to a high flow rate.

4. The method of pre-preparing a liquid delivery device valve as claimed in claim 1 wherein in the step of connecting the pump to a fluid reservoir, the pump is connected to a reservoir containing ethanol.

5. The method of pre-preparing a liquid delivery device valve as claimed in claim 1 wherein in the step of running the pump, the pump is run so as to deliver fluid through the liquid delivery device up to a maximum pressure of substantially 500 Bar.

6. The method for pre-preparing a liquid delivery device valve as claimed in claim 1 wherein in the step of running the pumping system, a plurality of full pump sequences are run.

7. The method of pre-preparing a liquid delivery device valve as claimed in claim 1 wherein the valve comprises a one-way valve, the method comprising the further step of:

(iv) reversing the direction of flow so that flow is in the normal use direction, to check that the valve is not stuck and still shuttles correctly.

8. The method of pre-preparing a liquid delivery device valve as claimed in claim 7 comprising the further step of:

(v) again changing the direction of flow, to check that robust sealing has been achieved.

9. The method of pre-preparing a liquid delivery device valve as claimed in claim 1 wherein in any one or more of steps (i) to (vi), the pressure is measured within that part of the liquid delivery device that contains the valve.

* * * * *